US005657832A

United States Patent [19]

Stevens

[11] Patent Number: 5,657,832

[45] Date of Patent: Aug. 19, 1997

[54] STAIRWAY FOR CONNECTING A FLOATING MEMBER TO A STATIONARY MEMBER

[76] Inventor: Robert C. Stevens, 3124 Ash Little River Rd., Ash, N.C. 28420

[21] Appl. No.: 562,058

[22] Filed: Feb. 28, 1996

[51] Int. Cl.[6] ..... E06C 9/06

[52] U.S. Cl. ..... 182/1; 182/96

[58] Field of Search ..... 182/1, 96

[56] References Cited

U.S. PATENT DOCUMENTS

| | | | |
|---|---|---|---|
| 300,395 | 6/1884 | Peterson | 182/1 |
| 616,515 | 12/1898 | Williams | 182/1 |
| 1,944,159 | 1/1934 | Bailey | 182/1 |
| 3,183,998 | 5/1965 | Major . | |
| 3,604,532 | 9/1971 | Moore . | |
| 3,970,169 | 7/1976 | Hernandez . | |
| 4,035,861 | 7/1977 | Edge . | |
| 4,153,137 | 5/1979 | Johnson . | |
| 4,161,795 | 7/1979 | Quest . | |
| 4,168,764 | 9/1979 | Walters | 182/1 |
| 4,838,735 | 6/1989 | Warner . | |
| 4,945,595 | 8/1990 | Meriweather . | |
| 5,581,784 | 12/1996 | Rousseau . | |

FOREIGN PATENT DOCUMENTS

| | | | |
|---|---|---|---|
| 22933 | 10/1904 | United Kingdom | 182/1 |

*Primary Examiner*—Alvin C. Chin-Shue
*Attorney, Agent, or Firm*—Terry M. Gernstein

[57] ABSTRACT

A stairway connects a stationary member, such as a fixed dock, to a member, such as a floating dock or a floating vessel, which moves vertically with respect to the stationary member. The stairway moves with the moving member and includes stringer members connected to hand rail members by picket members and step supporting pivot arms connected to adjustment arms in a manner which forms a compound parallelogram linkage in which the picket members and the pivot arms remain vertical during movement of the stairway whereby the steps remain horizontal and the hand rails remain parallel to the stringer members during such movement. The stairway includes wheels that rollably engage the moving member and moves between angular orientations as the moving member moves with respect to the stationary member. Steps are mounted on the pivot arms and include walking surfaces which remain horizontally oriented during movement of the stairway.

8 Claims, 11 Drawing Sheets

102
102
108
106
90
98
100

FIG. 10.
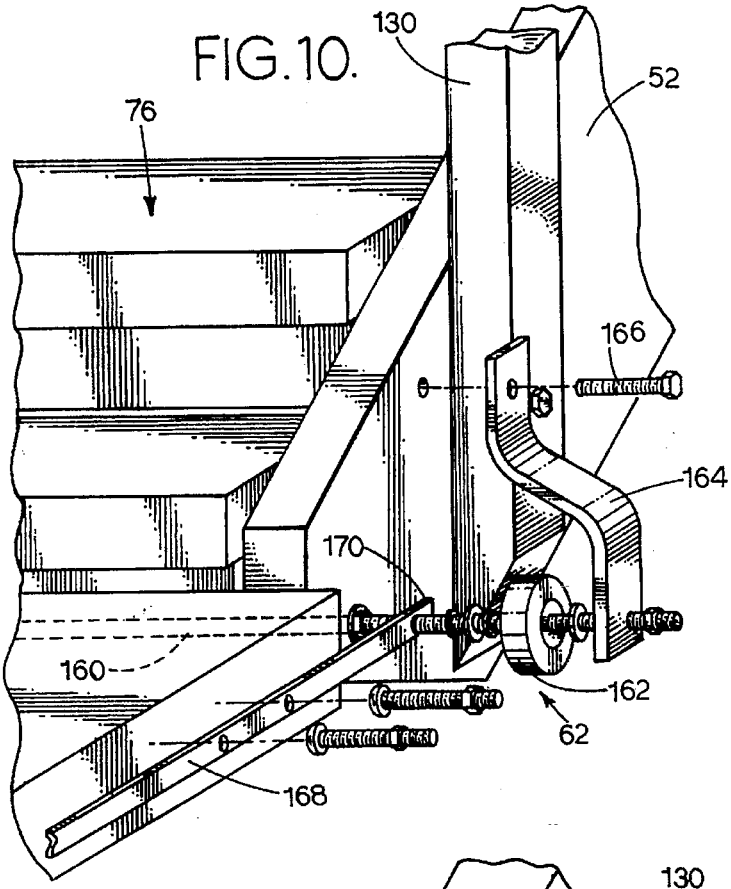
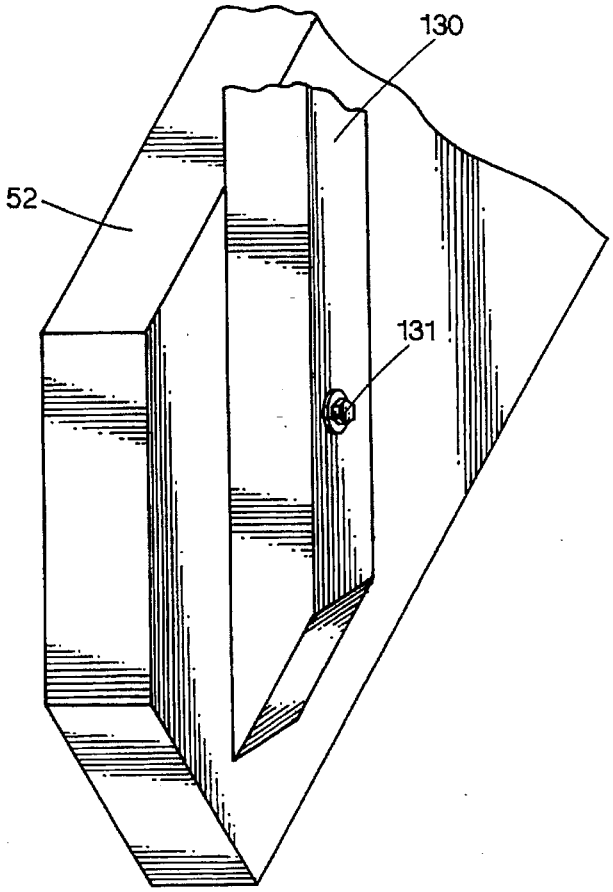
FIG. 11.

STAIRWAY FOR CONNECTING A FLOATING MEMBER TO A STATIONARY MEMBER

TECHNICAL FIELD OF THE INVENTION

The present invention relates to the general art of stairways and gangways, and to the particular field of means for connecting a dock-located item to a floating element, such as a ship.

BACKGROUND OF THE INVENTION

As is well known, a ship or other object which floats in a body of water changes its position with respect to a stationary object, such as a dock or pier, as the level of the body of water changes. The change in water level is generally associated with tides, but other causes can also influence the water level.

Movement of personnel and/or cargo between an object floating on the surface of a body of water and shore generally occurs via a stairway or a gangway. The stairway generally has one end thereof associated with the floating object and another end thereof associated with a stationary or fixed object on the shore. As the floating object moves under the influence of the changing water level, the angular orientation of the stairway with respect to both the floating object and the fixed object will change.

Accordingly, the art contains several examples of gangways or stairways that change their angles of orientation as a floating object moves under the influence of a changing water level. While somewhat successful, these known devices have several drawbacks. Specifically, the gangways known to the inventor do not maintain the walking surface thereof level as the gangway changes its angular orientation in an adequate and efficient manner. Therefore, someone using these known gangways must remain alert to a walking surface that may not be as level as necessary or may not be in the expected position.

Still further, the known stairways do not provide adequate handgrip means for a user. Ideally, the handgrip means should remain parallel to the walking surface as the stairway moves whereby a user can hold onto a handrail that is parallel to the walking surface.

Therefore, there is a need for a stairway for connecting a floating member to a stationary member and which maintains its walking surface or surfaces horizontal as the stairway changes its angular orientation. There is a further need for such a stairway which also includes handrails that remain parallel to the walking surface as the stairway changes its angular orientation.

OBJECTS OF THE INVENTION

It is a main object of the present invention to provide a stairway for connecting a stationary object to a moving object and which changes its angular orientation with respect to the stationary object in response to movement of the moving object but which maintains safe supporting surfaces during such change.

It is another object of the present invention to provide a stairway for connecting a stationary object to a moving object and which changes its angular orientation with respect to the stationary object in response to movement of the moving object and which includes steps that remain horizontal during such movement.

It is another object of the present invention to provide a stairway for connecting a stationary object to a moving object and which changes its angular orientation with respect to the stationary object in response to movement of the moving object and which includes handrails that remain parallel to the slope of the walking surface during such movement.

SUMMARY OF THE INVENTION

These, and other, objects are achieved by a stairway that connects a stationary object, such as an object on a dock, to a moving object, such as a floating vessel, and which includes elements that are pivotally connected together in a manner that maintains the walking surfaces of the stairway portion level and the handrail portion of the stairway parallel to the slope of the walkway. This means includes a compound parallelogram linkage which has vertical links that remain vertical as horizontal links move in response to movement of the floating object.

The compound parallelogram linkage causes the steps of the stairway to remain horizontally oriented during movement of the stairway in response to movement of the moving object. This same linkage maintains the steps horizontally oriented and the handrails of the stairway parallel to the slope of the steps whereby a user is sure where the steps are, how they will be oriented, and where the handrail is and how it will be oriented.

BRIEF DESCRIPTION OF THE DRAWING FIGURES

FIG. 10 shows a wheel assembly which connects one of the two wheels to the stairway stringer members so the wheel can roll on a top surface of a floating element, such as a dock.

FIG. 11 is a view of a lower picket assembly which connects a picket to a stringer.

DETAILED DESCRIPTION OF THE PREFERRED EMBODIMENT OF THE INVENTION

As used herein, the term "linkage" means a mechanism that is a combination of links or elements which are connected by pins or other such pivot means. A parallelogram linkage includes a frame element and a coupler element which are connected together by crank elements. The corresponding elements remain parallel to each other during movement of the linkage. In the stairway embodying the present invention, stringers correspond to the crank elements, handrails correspond to the coupler elements, and pickets and pivot arms correspond to the crank elements. One member of each parallelogram linkage is a vertically oriented member that corresponds to a crank element.

Figure 1A:
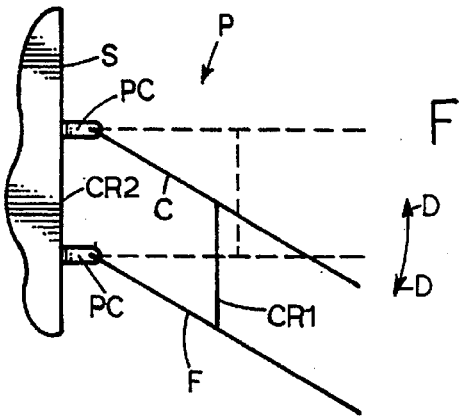
FIG. 1A is a schematic showing a parallelogram linkage.

By way of example, as used herein, a parallelogram linkage P is shown in FIG. 1A and includes a frame element F and a coupler element C connected together by crank elements CR1 and CR2. Frame element F is pivotally connected to a stationary member S by a pivot connection PC to pivot about that connection in directions U and D as indicated by the double-headed arrow. As can be understood from FIG. 1A, as linkage P pivots, from the full line position to the dotted line position, the links F, CR1, CR2 and C do not change their lengths, and links F and C remain parallel to each other while crank elements CR1 and CR2 remain parallel to each other. If crank element CR2 is the stationary member that remains vertical, then crank element CR1 will remain vertical during the pivoting movement of linkage P.

Figure 1B:
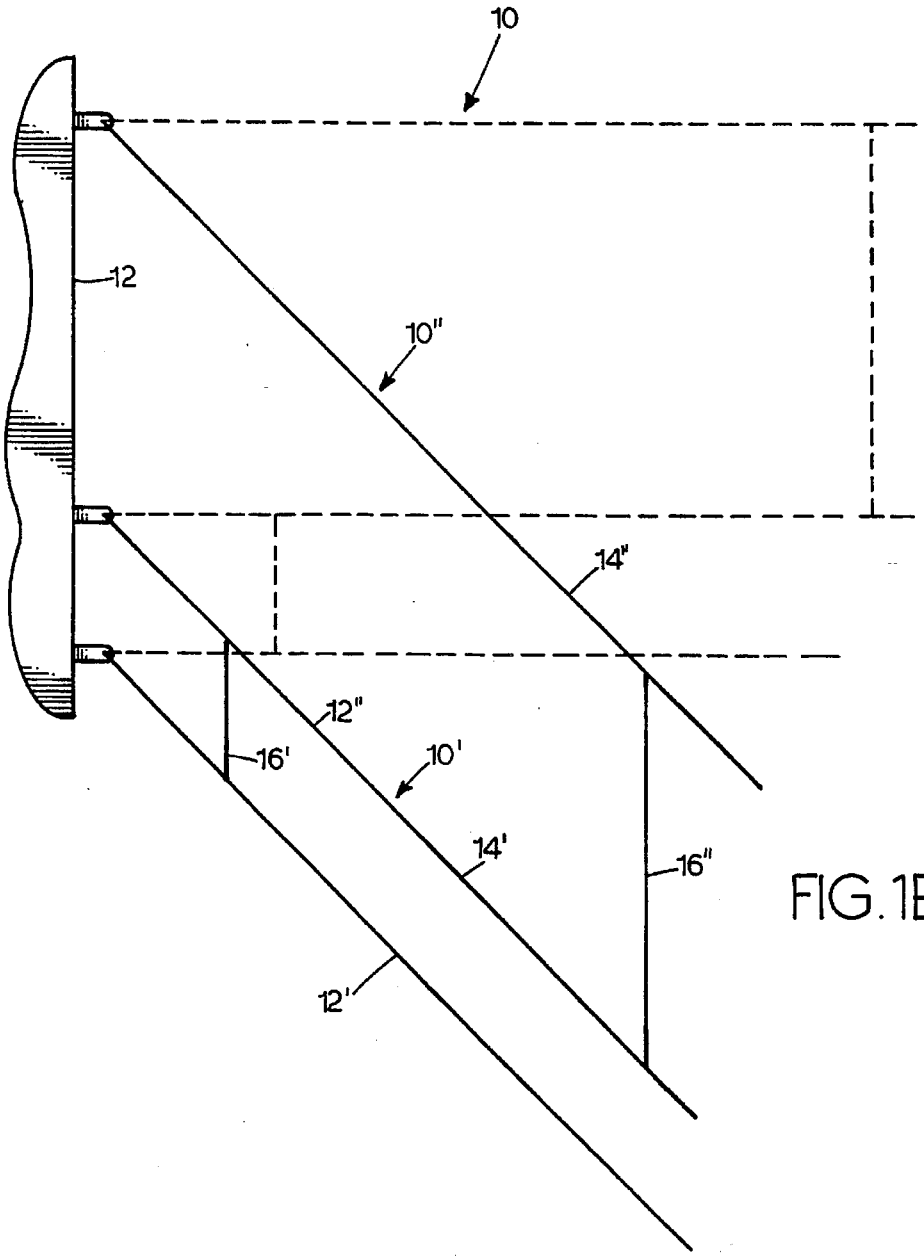
FIG. 1B is a schematic showing a compound parallelogram linkage.

The present invention uses a compound parallelogram linkage 10 which is shown in FIG. 1B. Compound parallelogram linkage 10 includes two linkages 10' and 10" coupled to a stationary member 12. Linkage 10' includes a frame element 12' and a coupler element 14' connected together by crank elements 16' and 12. Linkage 10" includes a frame element 12" which is coupler element 14', and coupler element 14" connected to the frame element by crank elements 16" and 12. Due to the commonality of frame element 12', the linkages 10' and 10" move together as a unit whereby the crank elements 16' and 16" are parallel to each other during movement of the compound linkage 10 between the full line position and the dotted line position shown in FIG. 1B. Also, due to the commonality of the frame element 12' and the stationary member, the coupler element 14' and the coupler element 14" remain parallel to each other during this movement of the linkage 10'. In the present invention, stationary member 12 is vertically oriented, therefore, the crank elements 16' and 16" remain vertically oriented during the movement of the compound linkage.

Figure 2A:
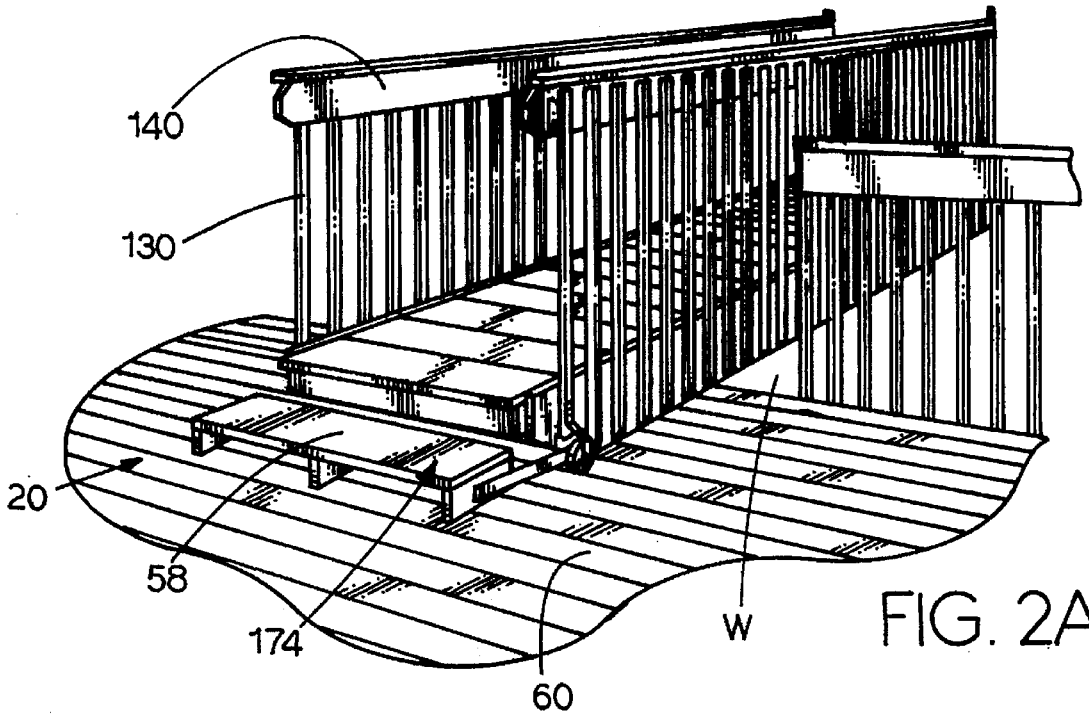
FIG. 2A is a side elevational view of the stairway embodying the present invention in one orientation.
Figure 2B:
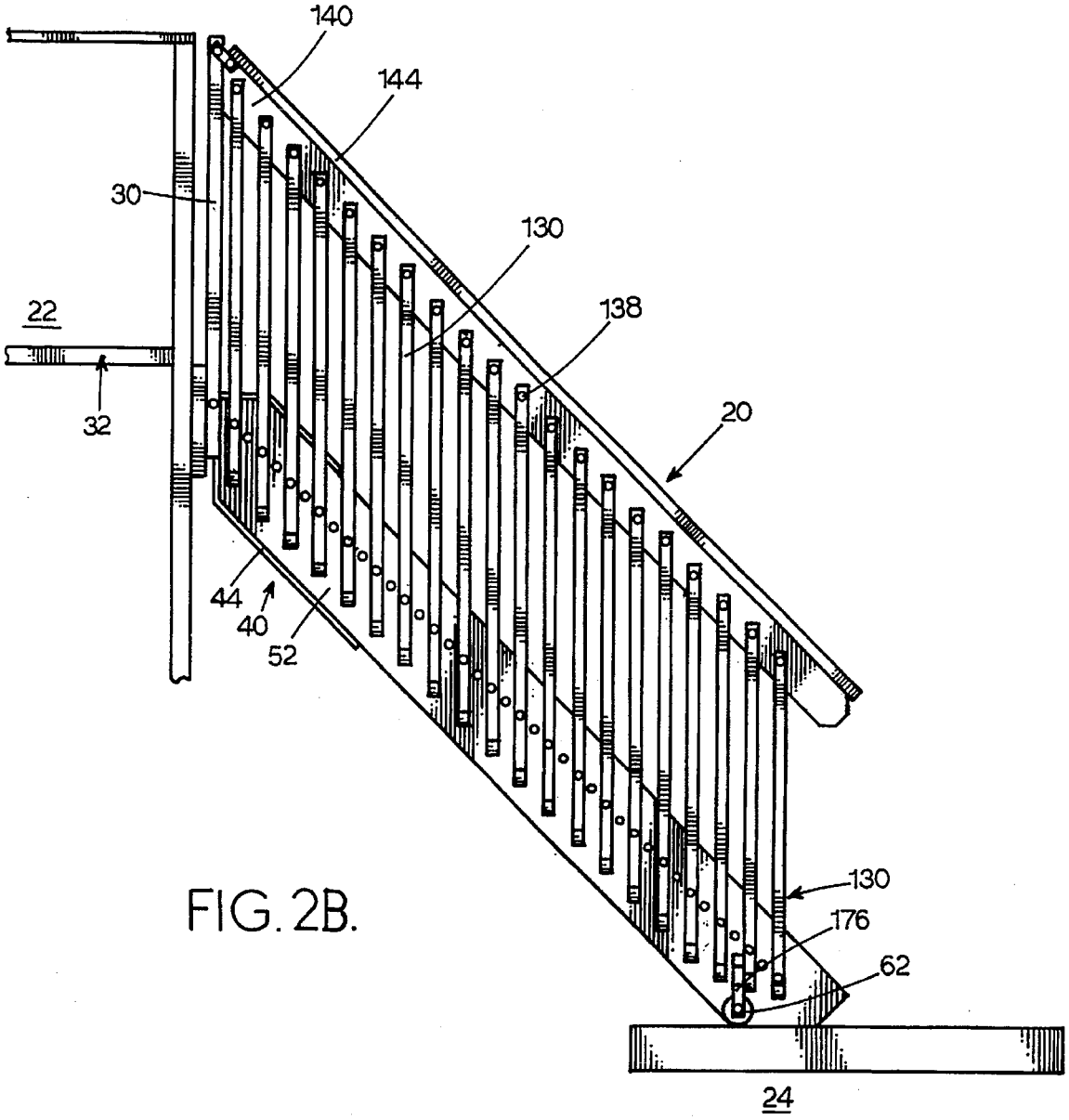
FIG. 2B is a side elevational view of the stairway embodying the present invention in a second orientation.

The stairway embodying the present invention is shown in two different positions, a horizontal orientation (which might correspond to high tide) in FIG. 2A and an upright orientation (which might correspond to low tide) in FIG. 2B.

Stairway 20 is shown in FIGS. 2A and 2B as connecting stationary member 22 located on a shore, to a floating member 24 that is on water W and moves with the water level. Member 24 moves vertically from substantially level with the shore line as shown in FIG. 2A to well beneath the shore line as shown in FIG. 2B whereby stairway 20 moves between a first angular orientation with respect to the stationary member, shown in FIG. 2A, and a second angular orientation with respect to the stationary member, shown in FIG. 2B. As one skilled in the art will understand from the ensuing disclosure, due to the connection between the elements of stairway 20, various elements will undergo the same angular re-orientation, while other elements will not re-orient during movement of the stairway.

Figure 3:
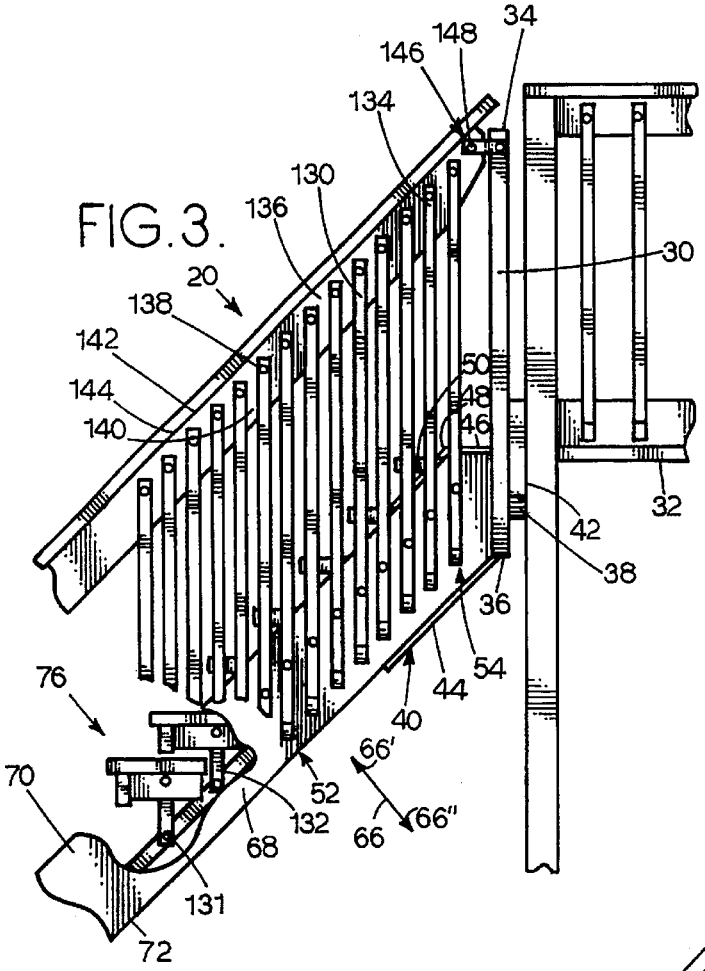
FIG. 3 is a top section of the stairway.
Figure 4:
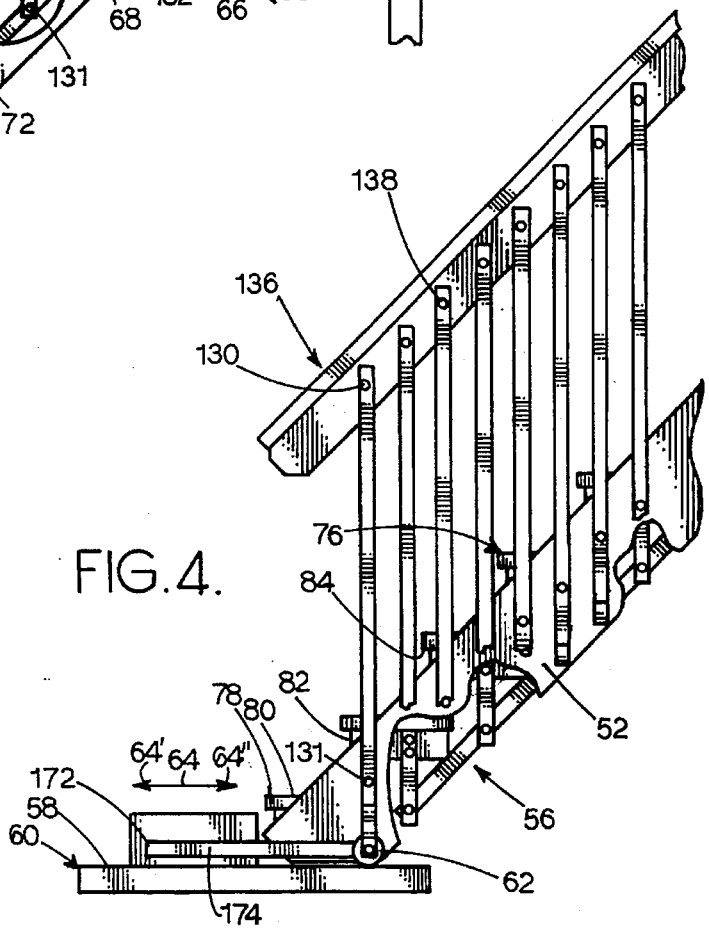
FIG. 4 is a bottom section of the stairway.
Figure 5:
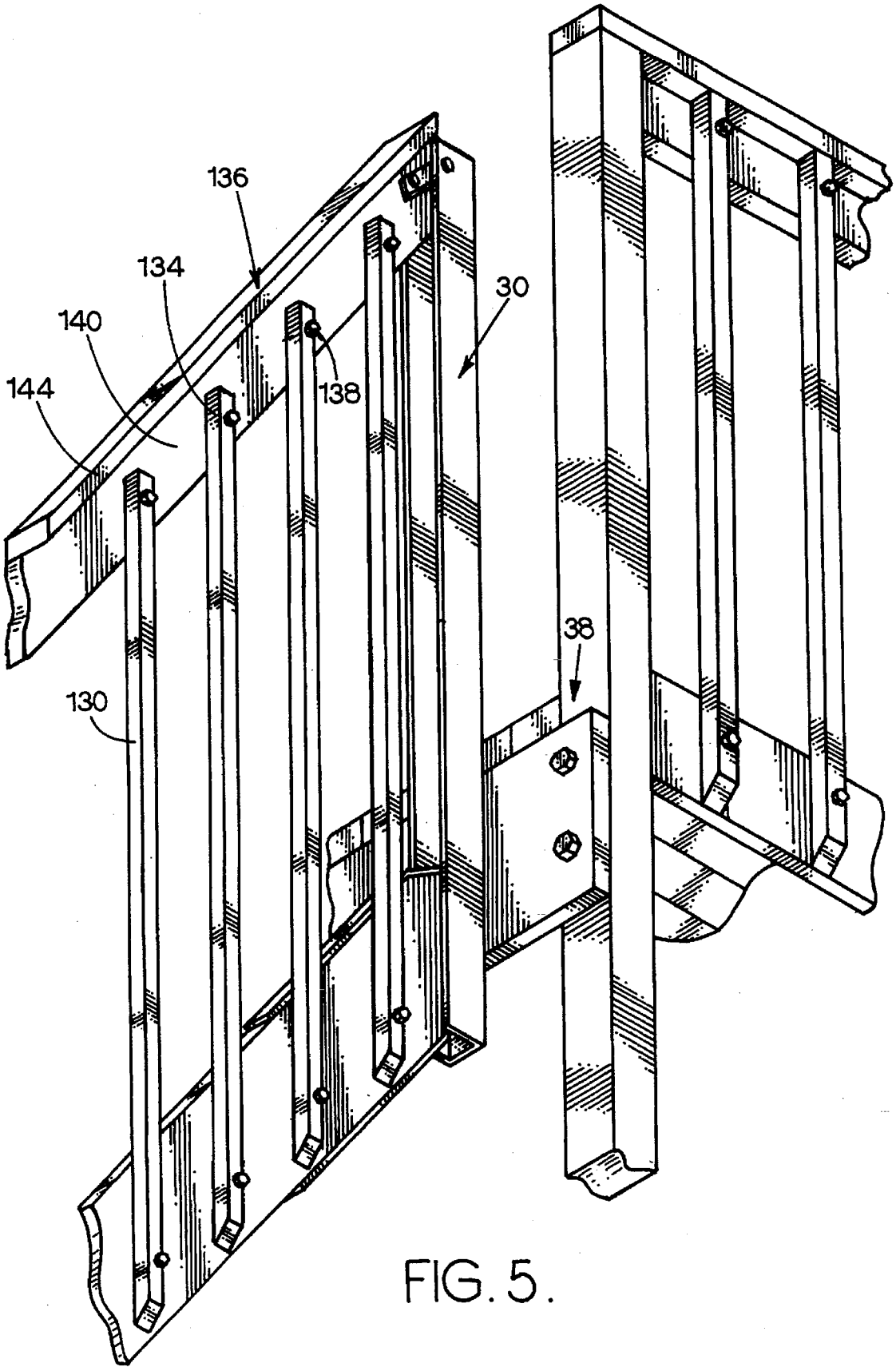
FIG. 5 is a perspective view showing the connection between a stabilizer element and the stairway.

As is best shown in FIGS. 3 and 4, stairway 20 includes stationary member 30, also known as a stabalizer element, fixedly anchored to stationery element, such as fixed dock 32 located on stable shore ground G. Member 30 includes a top end 34 and a bottom end 36, and is fixed to dock 32 by a tie member 38 (see FIGS. 3 and 5) located adjacent to end 36. A U-shaped bracket 40 is fixed to stationary member 30 and includes a body 42 to which is attached a long leg 44 and a short leg 46, with short leg 46 being bent into a top section 48 and a second section 50. There are two such elements as will be understood by one skilled in the art from the teaching of the present disclosure. However, like the other elements of stairway 20, only one element will be discussed in the interest of brevity.

Two stringer members, such as stringer member 52, are each attached to the stationary member by the bracket 40 to pivot between a first position shown in FIG. 2A and a second position shown in FIG. 2B. Each stringer member includes as proximal end 54 attached to the bracket 40 and a distal end 56 which is adapted to be located adjacent to top surface 58 of floating element 60, such as a floating dock or the like. Distal end 56 engages top surface 58 via a wheel mechanism 62 which moves in two directions Shown by double-headed arrow 64 as the dock moves vertically up (direction 64') and down (direction 64"). As proximal end 56 moves, the stringer pivots in two directions as indicated by double-headed arrow 66, with direction 66' corresponding to direction 64' and direction 66" corresponding to direction 64'. Each stringer member includes a body 68 having a top edge 70 and a bottom edge 72. The top and bottom edges are parallel to each other, and the top edge is shaped at the stringer proximal end as shown in FIG. 3 to be properly oriented to receive traffic from the fixed dock.

Figure 6:
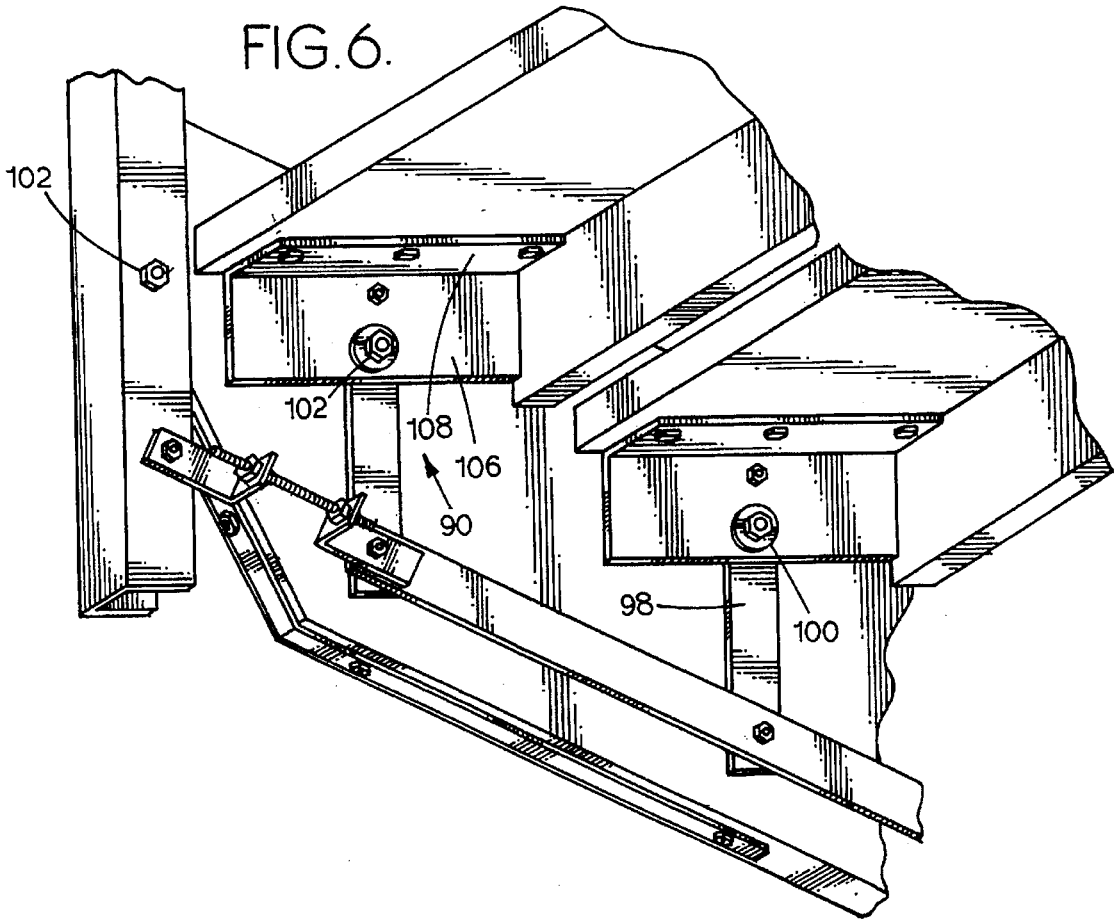
FIG. 6 is a view taken from beneath the stairway showing a portion of the stabilizer linkage in position on the stairway.
Figure 7:
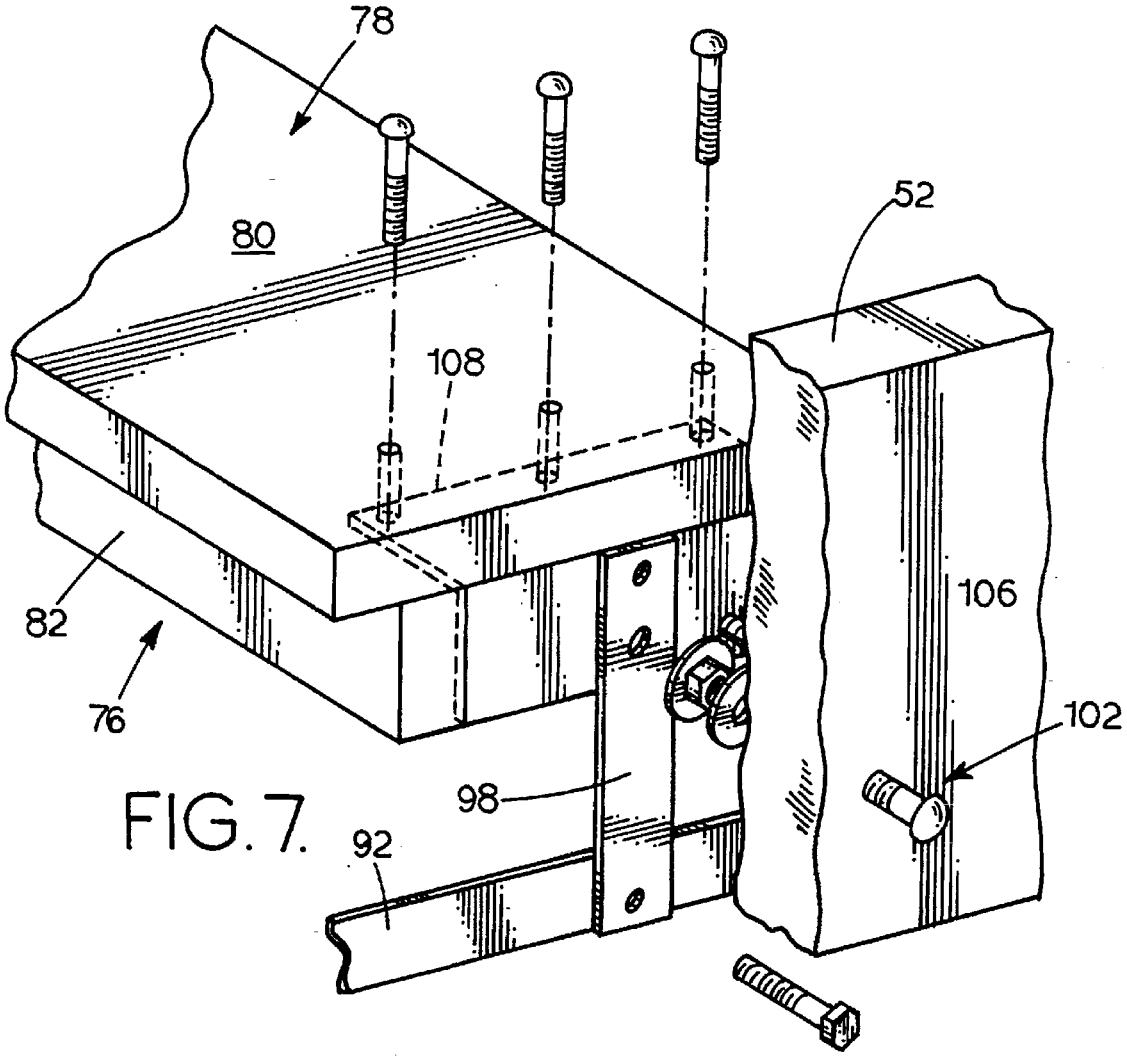
FIG. 7 is a view showing a step tread pivot.

A multiplicity of step units are connected to the stringers to span the distance between the stringers. All of the step mechanisms are identical; therefore, only one mechanism will be discussed. As is best shown in FIGS. 3, 4 and 6, each step mechanism 76 includes a step body 78 which has a walking surface 80 having a toe board 82 depending therefrom. Each step also includes a step bottom surface 8.4. Step walking surface 80 is presented upwardly to be walked on by persons traveling between the fixed dock and the floating dock, or to support other traffic or material being moved between shore and the floating object. As will be understood from the teaching of this disclosure, the step walking surfaces are stably and reliably maintained in a horizontal orientation at all times as the stairway moves in directions 66' and 66". This is achieved using a unique compound parallelogram linkage as will be discussed below.

Figure 8:
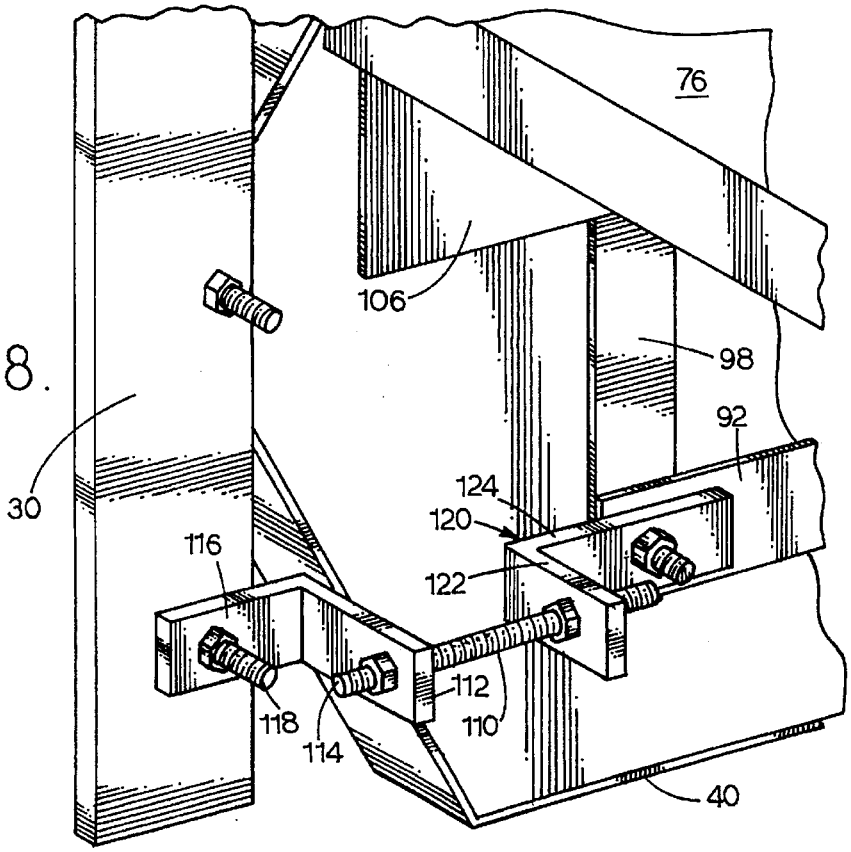
FIG. 8 is a view showing the step tread leveling adjustment mechanism.

As shown in FIG. 6, each step is pivotally attached to the stringer members 52 by a linkage mechanism 90. Each linkage mechanism 90 is associated with one end of the associated steps and includes an adjustment arm 92 having a proximal end 94 pivotally attached to the stationary member as shown in FIG. 8, and a distal end 96 located adjacent to distal end 56 of the stringer member associated therewith. Adjustment arm 92 moves in conjunction with the stringer member associated therewith as will be understood from the ensuing discussion and corresponds to the frame element 12' discussed above in regard to FIG. 1B. The associated stringer member corresponds to coupler link 14' of linkage 10'. A pivot arm 98 is pivotally connected at a proximal end thereof to the adjustment arm and has a distal end 100 pivotally connected to the stringer member by a fastener element 102, with the pivot arm corresponding to crank CR1 in linkage P and to 16' in linkage 10. The stringer member 52 is pivotally attached to the stationary member by pivot fastener 102 whereby the stationary member corresponds to crank element CR2 and to crank 12 in linkage 10'. Due to the parallelogram linkage connection, as the stringer members pivot, pivot arms 98 remain parallel to the vertically oriented stationary member 30.

An L-shaped bracket arm 104 has a leg 106 extending vertically and parallel to the stationary member 30 and a top leg 108 which extends horizontally. The steps are attached at each end thereof to one of the top legs and thus remain horizontal during movement of the stringer members. As shown in FIG. 8, the proximal end of the adjustment arm 92 is pivotally connected to the stationary member by a threaded fastener 110 attached to a leg 112 of an L-shaped bracket 114 which has a second leg 116 pivotally attached to the stationary member 30 by a threaded pivot fastener 118. An L-shaped bracket 120 has one leg 122 attached to one end of the fastener 110 and a second leg 124 attached to the adjustment arm 92 adjacent to the proximal end thereof. Threaded fastener 110 permits lengthwise adjustment of the adjustment arm.

Referring back to FIGS. 3, 4, it is seen that stairway 20 includes a multiplicity of picket members 130, each connected by a fastener 131 at a proximal end 132 to a stringer member 52 and having a distal end 134 spaced from the bottom end. A hand rail 136 is pivotally attached by fasteners 138 to the distal ends of the picket members and is parallel to the stringer members 52. The hand rail 136 includes a body 140 having a top edge 142 to which is attached a hand engaging member 144. Each hand rail is pivotally connected at a proximal end 146 thereof to the stationary member 30. A strap member (see FIG. 3) serves as the means for connecting the hand rail 136 to the stationary member 30.

By comparing FIGS. 3 and 4 to FIG. 1B, it can be seen that picket members 130 correspond to crank arms 16", stringer member 68 corresponds to frame element 12" and hand rail 136 corresponds to coupler element 14". During movement of the stringer member, due to the parallelogram linkage connection, picket members 130 remain vertical and parallel to vertically oriented stationary member, while hand rail members remain parallel to the stringer members.

Due to the compound parallelogram linkage set up, the steps of the stairway remain horizontally oriented, the picket members remain vertical and the hand rail members remain parallel to the stringer members during pivoting movement of the stairway.

Figure 9:
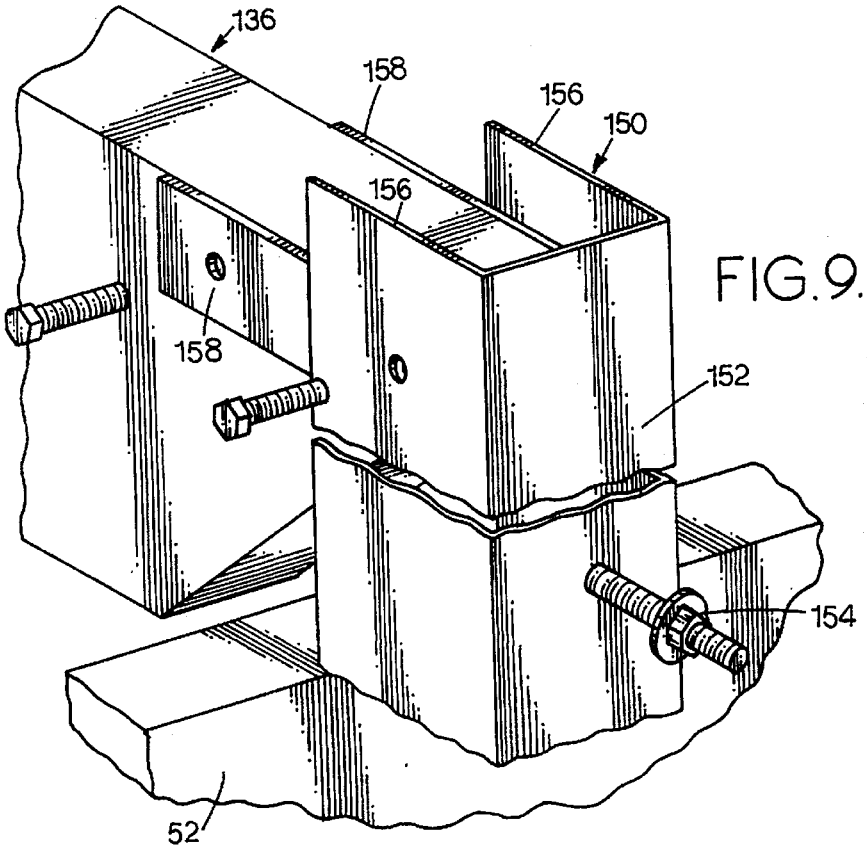
FIG. 9 is a view showing an upper hand rail of the stairway.
Figure 12:
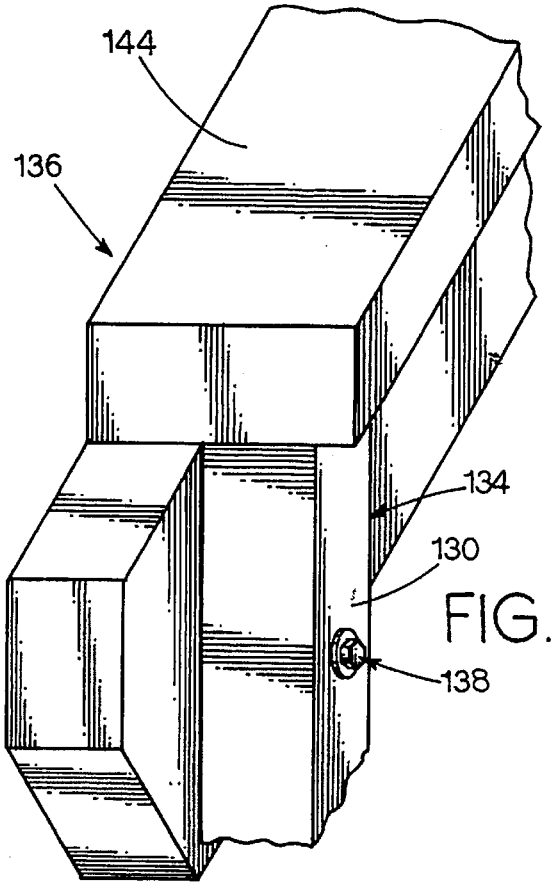
FIG. 12 is view of an upper picket assembly which connects a picket to a handrail.

Details of the various connections are shown in FIGS. 5, 7, 9, 11 and 12. As can be seen in FIG. 9, a U-shaped bracket 150 has a body 152 connected to the fixed dock by a threaded fastener 154 and has two legs 156 each attached to the hand rail by plates 158.

Referring to FIGS. 2 and 10, the wheel mechanism 62 is shown as including an axle 160 extending between the stringer members and having a wheel 162 rotatably mounted on each end thereof. A wheel axle brace 164 is fixed to a corresponding stringer member by a threaded fastener 166 and has a distal end supportingly connected to the axle. An extension arm 168 has a proximal end 170 connected to axle 160 and a distal end 172 thereof connected to one side of a slider step.174. The slider step engages top surface 58 of the floating dock and moves in directions 64' and 64". Slider step 174 remains parallel to surface 58 and is the first step of the stairway adjacent to the floating dock. It is noted that FIG. 2A shows an alternative form of the stairway which omits the sliding step and has the wheel mechanism connected to the stringer members by arms, such as arm 176.

Figure 13:
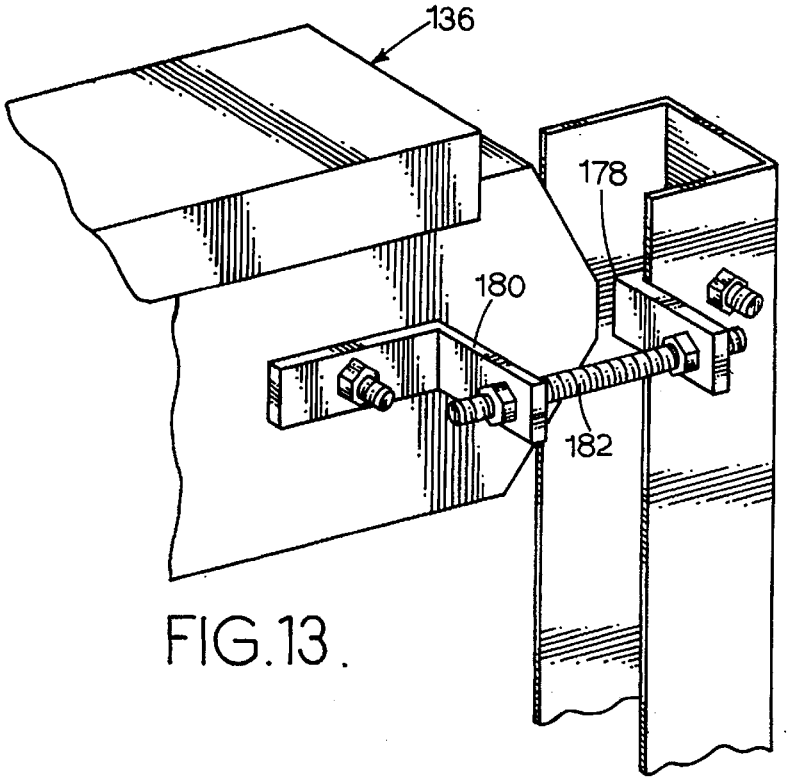
FIG. 13 is a perspective view of a leveling connection used in an alternative form of the invention.
Figure 14:
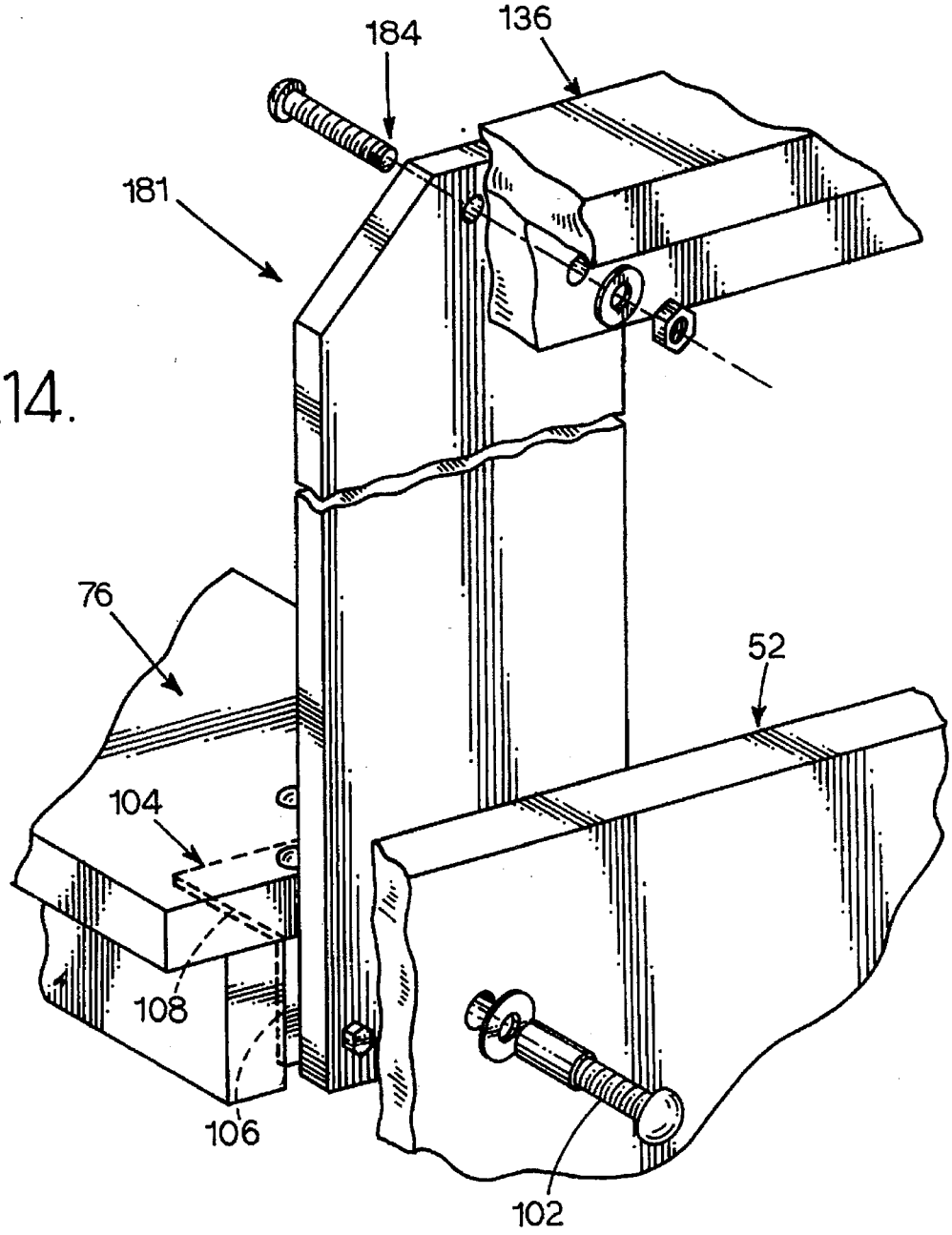
FIG. 14 is a perspective view of a picket showing an alternative form of the picket.

A further alternative form of the steps is shown in FIGS. 13 and 14 in which the hand rails are each connected to the stationary member 30 by two L-shaped brackets, first bracket 178 and second bracket 180 which are coupled together by a threaded fastener 182. As shown in FIG. 14, the top 181 of the pickets can be in the form of a truncated pyramid which is connected to the hand rail by a pivot fastener 184.

It is also noted that the various threaded fastener members can be used to adjust the stairway after it has been installed on the fixed dock.

It is understood that while certain forms of the present invention have been illustrated and described herein, it is not to be limited to the specific forms or arrangements of parts described and shown.

I claim:

1. A stairway adapted to connect a fixed member to a floating member, such as a boat, or the like, which moves vertically under the influence of a changing water level comprising:

A) two stringer members, each stringer member including
  (1) a proximal end,
  (2) a distal end,
  (3) a top edge, and
  (4) a bottom edge;

B) pivoting means for pivotally connecting the proximal end of each stringer member to a fixed member;

C) wheel means connected to the distal end of each stringer member and adapted to rollably engage a surface of a floating member, said stringer members pivoting about said pivoting means as said wheel means rolls on said surface whereby said stringer members move between a first angular orientation with respect to said fixed member and a second angular orientation with respect to said fixed member;

D) an adjustment arm associated with each stringer member, each adjustment arm including
  (1) a proximal end located near the proximal end of the associated stringer member, and
  (2) a body;

E) a plurality of pivot arms associated with each adjustment arm, each pivot arm including
  (1) a proximal end pivotally attached to the adjustment arm associated therewith,
  (2) a pivot means for pivotally connecting said pivot arm to the stringer member associated with the adjustment arm, and
  (3) a distal end;

F) an L-shaped bracket means connected to the distal end of each pivot arm;

G) a plurality of steps, each step connected to two of said bracket means and extending between said stringer members;

H) a plurality of picket members, each picket member including
  (1) a proximal end pivotally connected to one stringer member, and
  (2) a distal end;

I) two hand rail members, each hand rail member including
  (1) a proximal end pivotally connected to said fixed member, and
  (2) a distal end;

J) means pivotally connecting the distal end of each picket member to one of said hand rail members; and K) means for permitting lengthwise adjustment of each adjustment arm with respect to the fixed member and connecting the distal end of each adjustment arm to the fixed member and including (1) a first L-shaped bracket connected to the distal end of the adjustment arm, (2) a pivot element on the fixed member, (3) a second L-shaped bracket connected to said pivot element to be pivotally connected to the fixed member, and (4) a threaded fastener threadably connected to both of said first and second L-shaped brackets and connecting said first and second L-shaped brackets together to move toward and away from the fixed member.

2. The stairway defined in claim 1 further including an additional step member located adjacent to the distal ends of said stringer members, and means connecting said additional step member to said wheel means.

3. The stairway defined in claim 1 further including a toe piece on each step member.

4. The stairway defined in claim 1 further including pivoting means for connecting each hand rail to the fixed member including a pivot strap connecting one end of an associated hand rail to the fixed member.

5. The stairway defined in claim 1 wherein said wheel means includes two wheels and further including an axle connecting said wheels together.

6. The stairway defined in claim 1 wherein said first angular orientation is horizontal.

7. The stairway defined in claim 1 further including a hand rail adjustably connected to the fixed member.

8. The stairway defined in claim 7 further including means for permitting lengthwise adjustment of said hand rail with respect to the fixed member and connecting the hand rail to the fixed member and including (1) a first L-shaped bracket element connected to a distal end of the hand rail, (2) a pivot member on the fixed member, (3) a second L-shaped bracket element connected to said pivot member to be pivotally connected to the fixed member, and (4) a threaded fastener element threadably connected to both of said first and second L-shaped bracket elements and connecting said first and second L-shaped bracket elements together to move toward and away from the fixed member.

* * * * *